US011104476B2

(12) United States Patent
Zhang et al.

(10) Patent No.: US 11,104,476 B2
(45) Date of Patent: Aug. 31, 2021

(54) PACKAGE HAVING A SHEET-COVERED CUTOUT

(71) Applicant: Amazon Technologies, Inc., Seattle, WA (US)

(72) Inventors: Qi Zhang, Chiba (JP); Ryo Igarashi, Kanagawa (JP); Yuichi Kosaka, Saitama (JP); Masahiro Uchida, Osaka (JP); Susumu Yamasaki, Chiba (JP); Shigekazu Ishiguro, Osaka (JP); Sayaka Kishimoto, Osaka (JP)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/044,304

(22) Filed: Jul. 24, 2018

(65) Prior Publication Data

US 2020/0031515 A1 Jan. 30, 2020

(51) Int. Cl.

| | |
|---|---|
| ***B65D 5/50*** | (2006.01) |
| ***B65D 25/10*** | (2006.01) |
| ***B65D 5/28*** | (2006.01) |
| ***B65D 5/02*** | (2006.01) |
| *B31B 105/00* | (2017.01) |

(52) U.S. Cl.

CPC ..... *B65D 5/5088* (2013.01); *B65D 5/0272* (2013.01); *B65D 5/28* (2013.01); *B65D 25/101* (2013.01); *B31B 2105/002* (2017.08)

(58) Field of Classification Search

CPC ..... B65D 5/5088; B65D 5/0272; B65D 5/28; B65D 25/101; B65D 5/4204; B65D 2571/00018; B65D 2571/0029; B65D 2571/00679; B65D 73/0085

USPC ..... 229/164.1, 113, 162.1; 206/779, 497, 206/432, 775, 776, 525, 765, 769; 53/410, 48.2; 428/339

See application file for complete search history.

(56) References Cited

U.S. PATENT DOCUMENTS

| | | | | |
|---|---|---|---|---|
| 4,647,714 | A * | 3/1987 | Goto | B32B 15/04 174/36 |
| 5,411,138 | A * | 5/1995 | Klawiter | B65D 5/5088 206/335 |
| 5,506,046 | A * | 4/1996 | Andersen | C08L 1/28 428/34.5 |
| 5,944,252 | A * | 8/1999 | Connelly | B31D 3/005 229/132 |
| 7,021,524 | B1 * | 4/2006 | Becker | B65D 5/5088 206/521 |
| 7,070,055 | B2 * | 7/2006 | Lechanoine | B65D 3/04 206/223 |
| 8,074,952 | B2 * | 12/2011 | Baechle | D06F 39/001 248/346.03 |
| 9,505,515 | B2 * | 11/2016 | Vistrom | B65D 65/403 |

(Continued)

FOREIGN PATENT DOCUMENTS

| | | |
|---|---|---|
| JP | 2010-120646 A | 6/2010 |
| JP | 2012-041060 A | 3/2012 |

(Continued)

*Primary Examiner* — Christopher R Demeree
(74) *Attorney, Agent, or Firm* — BakerHostetler

(57) ABSTRACT

A package is formed of a die cut paperboard that includes a cutout that is covered by a polymer sheet. The sheet holds an item, such as by stretching, against the bottom side of the unpadded paperboard, which is chosen according to its ability to be transported on metal roller conveyors.

22 Claims, 2 Drawing Sheets

(56) References Cited

U.S. PATENT DOCUMENTS

| | | | | |
|---|---|---|---|---|
| 10,233,005 | B1 * | 3/2019 | De Bonet | B65D 81/052 |
| 2002/0139834 | A1 * | 10/2002 | Becker | B65D 5/62<br>229/103.11 |
| 2008/0190785 | A1 * | 8/2008 | Spivey | B65D 71/066<br>206/147 |

FOREIGN PATENT DOCUMENTS

| | | | |
|---|---|---|---|
| JP | 2014-046982 | A | 3/2014 |
| JP | 2018-087029 | A | 6/2018 |

* cited by examiner

PACKAGE HAVING A SHEET-COVERED CUTOUT

BACKGROUND

The present invention relates to packaging, and more particularly to a package having a cutout that is covered by a sheet.

Packaging consumer products for distribution to consumers in fulfillment centers occurs worldwide on a vast scale. Often, products are received in a fulfillment center in packaging from the manufacturer of the product, which often includes cushioning within the box or other outer container to protect the product.

The transportation infrastructure, such as the bins and bags used to transport groups of consumer packages, vary by geography and logistics provider. Accordingly, packages suitable for processing and transporting within one geography might be not suitable—either with insufficient cushioning or wasteful, extra cushioning—for processing and transporting in another country. For example, transportation infrastructure in certain geographies are relatively less severe or prone to damage a package than many countries.

DETAILED DESCRIPTION OF ILLUSTRATIVE EMBODIMENTS

Figure 2:
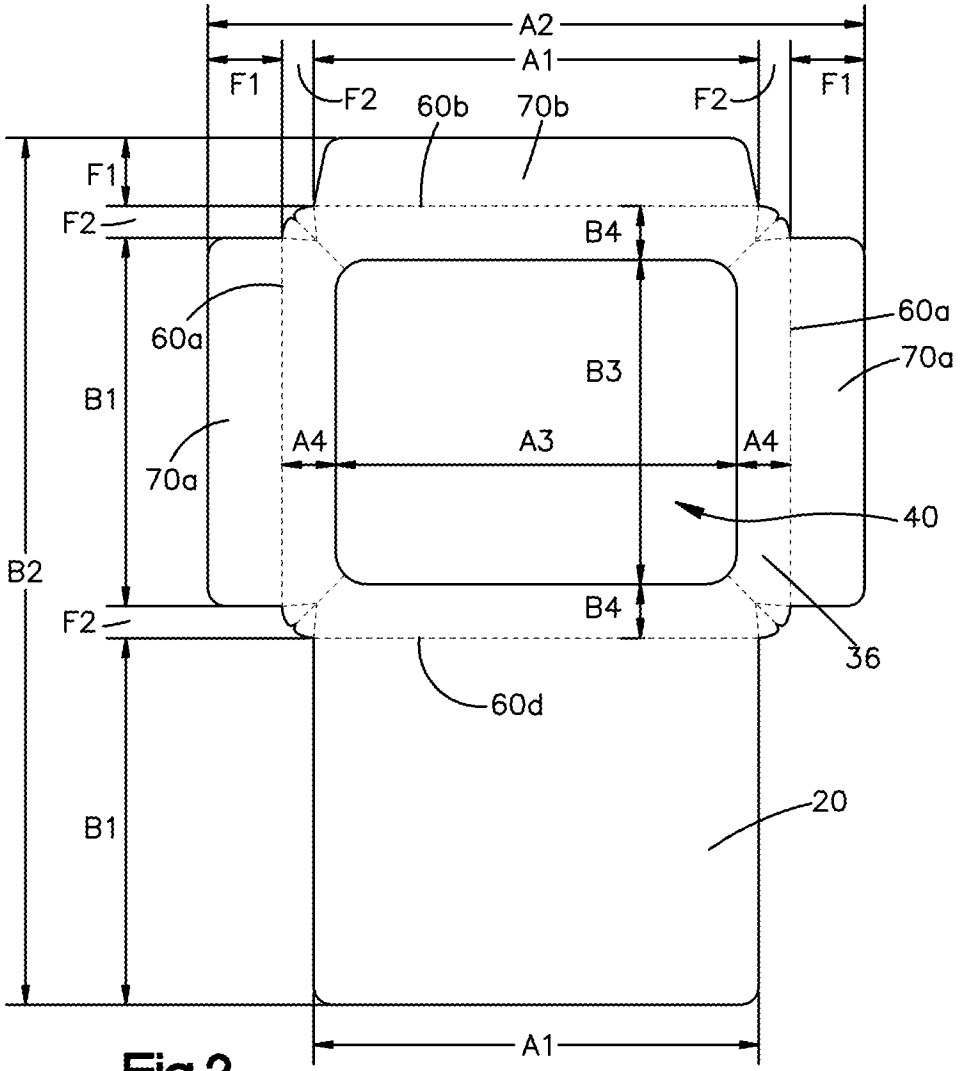
FIG. 2 is die cut paperboard drawing for forming the package of FIG. 1.

A clamshell-like package 10 disclosed herein makes efficient use of resources while securely retaining an item within the package and includes features for improving conveying and transporting. The package 10 includes one (bottom) side that is paperboard and an opposing side that includes a polymer sheet. The paperboard is chosen according to properties that make it suitable for being conveyed on a conventional metal roller conveyor. The polymer sheet is positioned over a cutout opposite the bottom side. When holding an item that is thicker than the at-rest, flat dimension of package 10, the polymer sheet stretches to hold the item against the paperboard of the bottom side.

In this regard, the package for holding items for transport, comprises: a body including an underside and a topside, the body being formed of paperboard and the topside including a cutout; and a polymer sheet covering the cutout, the polymer sheet being capable of stretching over an item in the package to restrain the item in the package during transport. The polymer sheet is adapted for retaining various items of non-uniform shapes against the inboard surface of the underside of the body.

The package body preferably is formed of paperboard with no added padding and has an outboard side of the paperboard, when measured on conventional steel roller conveyors (such as zinc coated steel) has a minimum coefficient of static friction of at least 0.43 measured according to JIS K 7125 standard. Further, the paperboard preferably has at least one of a stiffness of at least 28 mN·m measured according to JIS P 8125 standard and a thickness of at least 464 μm measured according to JIS p 8118: 2014 standard, and/or a basis weight of at least 360 g/m$^2$. Further, the paperboard may have at least one of a stiffness of at least 35 mN·m measured according to JIS P 8125 standard and a minimum thickness of 580 μm measured according to JIS p 8118: 2014 standard, and/or a basis weight of at least 450 g/m$^2$.

The topside may include a lip around the cutout having a dimension of at least 25 mm. The body may be formed from a single piece of die-cut paperboard, and the underside is separated from the topside by a single crease in the paperboard. The polymer sheet may be formed of a material comprising at least one of a polyethylene, a low density polyethylene, a polyvinyl chloride, and a polyvinylidene chloride.

A package as described in any of the above paragraphs holding an item such that the polymer sheet stretches over or is capable of stretching over an item in the package to restrain the item in the package during transport is also provided. An outboard surface of the underside of the body may include delivery information associated with the item. The item may be of various shapes such that the sheet stretches to accommodate different shapes and sizes while retaining the item against the paperboard. For items that require padding or cushioning, it is preferred that the item itself be wrapped in padding—that is, pre-packaged with padding.

A method for packaging and shipping an item includes the steps of: (a) enclosing one of various-shaped items in a package such that the item is held to a paperboard body of the package by a film that is stretched over the item and is stretched over a cutout in the body; (b) conveying a paperboard outboard contact surface of the body on metal rollers of a conveyor; and (c) transporting the package without exterior boxing to a recipient. The conveying step may include conveying the contact surface on the metal rollers wherein the coefficient of static friction therebetween the metal rollers and the contact surface is at least 0.43 measured according to JIS K 7125 standard. The method may include the step of adding a delivery address to the package before the transporting step (c).

Figure 1:
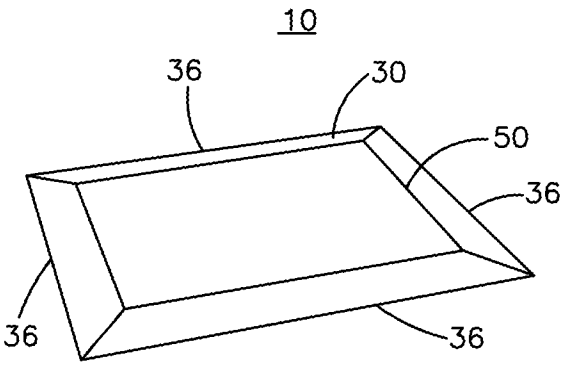
FIG. 1 is a top perspective view of a package illustrating aspects of the present invention.
Figure 3:
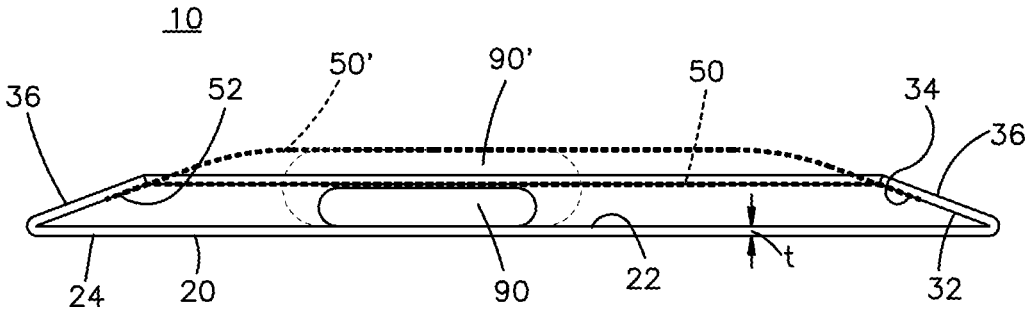
FIG. 3 is a cross sectional view of the package, illustrating a thin item contained in the package, and with a relatively thick item and the stretched sheet shown in dashed lines.

Referring to the FIGS. 1 through 3, package 10 includes an underside 20 and a topside 30 that are joined by creases 60*a*, 60*b*, 60*c*, and 60*d*. Underside 20 includes an interior or inboard surface 22 and an exterior-facing or outboard surface 24. Topside 30 includes a peripheral rim or lip 36 forming an aperture or cutout 40. Lip 36 has an inboard surface 32 and an exterior-facing outboard surface 34. Flaps 70*a*, 70*b*, and 70*c* extend from lip 36 and are adhered to underside 20 to fasten the package.

A polymer sheet 50 is adhered to onboard surface 32 of lip 36 at reference number 54, preferably continuously about cutout 40. As best illustrated in FIG. 3, sheet 50 may be approximately planar with lip 36 for an item 90 that itself is thin. FIG. 3 uses dashed lines to illustrate sheet 50' stretching about an item 90' that is relatively thick. In this regard, item 90 may be any product or article that is desired to be shipped. The properties, including thickness, of sheet 50 to enable it to stretch to the dashed line position 50' may chosen according to the particular parameters of the application.

Below are example values (in mm) for the dimensions called out on FIG. 2:

TABLE 1

| A1 | A2 | A3 | A4 | B1 | B2 | B3 | B4 | F1 | F2 |
|---|---|---|---|---|---|---|---|---|---|
| 315 | 450 | 280 | 35 | 255 | 595 | 220 | 35 | 50 | 17.5 |

According to one aspect of the present invention, the coefficient of static friction between the metal rollers of conventional roller conveyors and the paperboard of outboard surface 24 of underside 20 is least 0.43 measured according to JIS K 7125 standard. The material of metal roller is steel, such as material code STKM11A, with a zinc plating surface finish, as commonly used for roller conveyors.

The paperboard of underside 20 and lip 36 preferably have the following minimum values, using the stated Standard:

TABLE 2

| | Standard | Minimum value |
|---|---|---|
| Stiffness (mN · m) | JIS P 8125 | 35 |
| Thickness (μ m) | JIS P 8118: 2014 | 580 |
| Basis weight ($g/m^2$) | | 450 |

The inventors surmise that the values of Table 2 can be reduced by 20 percent, depending on the particular rollers or other parameters that the package may encounter. Thus, the stiffness of the paperboard may be at least 28 mN·m (milliNewton meters) measured according to JIS P 8125 standard (which may employ a Taber tester), the minimum thickness may be at least 464 μm measured according to JIS p 8118: 2014 standard, and the basis weight of the paperboard may be at least 360 $g/m^2$.

Sheet 50 may be any stretchable sheet of any suitable material. For example, sheet 50 can be any one of a polyethylene, a low density polyethylene, a polyvinyl chloride, and a polyvinylidene chloride, either in a single layer or in a combination of layers and compositions. Further, sheet 50 may include any additives to aid in its function, such as UV inhibitors, barriers of any type, and the like.

Figure 4:
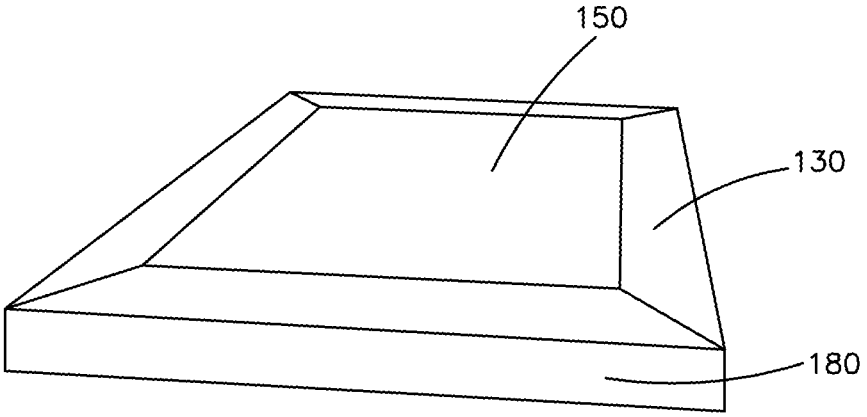
FIG. 4 is a perspective view of an alternative embodiment of the package.
Figure 5:
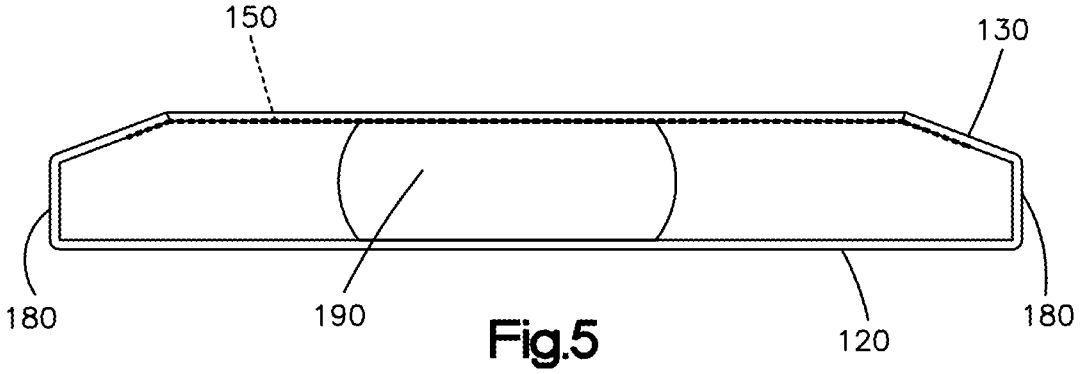
FIG. 5 is a cross sectional view of the alternative package embodiment of FIG. 4.

FIGS. 4 and 5 is another embodiment of a package 110 that includes an underside 120, a topside 130 having a cutout 140, sidewalls 180, and a polymer sheet 150. Package 110 is illustrated holding item 190 and is configured for stretching, as explained above.

Underside 120, topside 130, cutout 140, and sheet 150 may be as described for underside 20, topside 30, cutout 40, and sheet 50 for first embodiment package 10. Sidewalls 180 are vertical sidewalls that add depth to package 110. The vertical dimension of sidewall 180 may be chosen according to the particular items that package 110 is intended to carry.

The inventors have determined that costs of packaging raw materials can be optimized depending on a level of care existent in a transportation infrastructure. Specifically, the paperboard forming portions 20 and 36 preferably is a singly ply, without corrugations and without added cushioning or padding. The term "added" when referring to cushioning or padding refers to a layer in addition to the paperboard, as it is understood that the paperboard itself provides a small amount of cushioning. Preferably sheet 50 is also without added cushioning or padding, and preferably sheet 50 is a single sheet, such as a single layer or multiple thin layers, and preferably is not bubble wrap or the like. If an item 90 requires additional padding, item 90 may be pre-wrapped before insertion into package 10.

In use, package 10 can be assembled by folding creases 60*a* through 60*d* and gluing flaps 70*a*, 70*b*, and 70*c* onto the corresponding portion of underside 20. Sheet 50 is attached by gluing to surface 32 of lips 36. Item 90 is placed into package 10 before the final gluing of at least one of the flaps. Depending on the thickness of item 90, sheet 50 stretches as needed to hold item 90 against the inboard surface 22 of underside 20, which is illustrated by reference number 54 of FIG. 3. Package 10 may be conveyed, including by metal roller conveyor, on outboard surface 24 of underside 20. Shipping information, such as an address label of the intended recipient of item 90, may be placed on underside outboard surface 24 either before or after conveying on metal roller conveyors. Indicia, such as logos, advertising information, decoration, and the like may be pre-printed on outboard surface 34 of lip 36 or may be have a label affixed to surface 34, or both. The label or information on the underside and lip may be machine readable wherein desired.

The present invention is illustrated by describing preferred structure and function and in the context of particular problems and prior art. The present invention is not limited to the particular structure and/or function of the embodiments described herein, nor to solving any problem disclosed herein or drawback of the prior art. Rather, it is intended that the invention be given the full scope of the claims.

What is claimed:

1. A packaging comprising:

a body formed from a single piece of paperboard having a first lip, a second lip, a first flap extending from the first lip, and an underside extending from the second lip, wherein the first lip and the second lip at least partially form a topside defining a cutout, and wherein the first flap is bent and affixed to the underside; and a polymer sheet affixed to the first lip and the second lip to cover the cutout, the polymer sheet being configured to stretch over one or more items of different sizes upon insertion of the one or more items into the packaging to restrain the one or more items against the underside during transport.

2. The packaging of claim 1, wherein the body is padding-free.

3. The packaging of claim 1, wherein an outboard side of the underside on conventional steel roller conveyors has a minimum coefficient of static friction of at least 0.43 measured according to JIS K 7125 standard.

4. The packaging of claim 1, wherein the single piece of paperboard has at least one of a stiffness of at least 28 mN/m measured according to JIS P 8125 standard and a thickness of at least 464 μm measured according to JIS p 8118:2014 standard.

5. The packaging of claim 1, wherein the single piece of paperboard has a basis weight that is at least 360 $g/m^2$.

6. The packaging of claim 1, wherein each of the first lip and the second lip has a dimension of at least 25 mm.

7. The packaging of claim 1, wherein the polymer sheet comprises one or more of a polyethylene, a low density polyethylene, a polyvinyl chloride, or a polyvinylidene chloride.

8. The packaging of claim 1, wherein each of the one or more items is pre-packaged with padding about the item.

9. The packaging of claim 1, wherein the topside of the body includes information visible during transport.

10. The packaging of claim 1, wherein the polymer sheet is affixed to the topside using an adhesive.

11. The packaging of claim 1, wherein the first flap is affixed to the underside using an adhesive.

12. The packaging of claim 1, wherein the polymer sheet is affixed to all but one side of the topside before the one or more items are inserted into the packaging.

13. The packaging of claim 1, wherein the single piece of paperboard further has a third lip, a fourth lip, a second flap extending from the third lip, and a third flap extending from the fourth lip, and wherein the second flap and the third flap are bent and affixed to the underside.

14. A package comprising one or more items, the package comprising:

a body formed from a single piece of paperboard having a first lip, a second lip, a first flap extending from the first lip, and an underside extending from the second lip, wherein the first lip and the second lip at least partially form a topside defining a cutout, and wherein the first flap is bent and affixed to the underside;

a polymer sheet affixed to the first lip and the second lip to cover the cutout; and one or more items of a plurality of sizes, the one or more items being located between the underside and the polymer sheet such that the polymer sheet is configured to stretch over the one or more items upon insertion of the one or more items into the body to retain the one or more items against an inboard surface of the underside during transport, wherein at least one of an outboard surface of the underside and an outboard surface of the polymer sheet includes delivery information.

15. The package of claim 14, wherein the underside is padding-free.

16. The package of claim 15, wherein each of the one or more items is pre-packaged with padding about the item.

17. The package of claim 14, wherein the outboard surface of the underside on conventional steel roller conveyors has a minimum coefficient of static friction of at least 0.43 measured according to JIS K 7125 standard.

18. The package of claim 14, wherein the single piece of paperboard has at least one of a stiffness of at least 35 mN/m measured according to JIS P 8125 standard, a minimum thickness of 580 μm measured according to JIS p 8118:2014 standard, and a basis weight of 360 g/m$^2$.

19. The package of claim 14, wherein each of the first lip and the second lip has a dimension of at least 25 mm.

20. The package of claim 14, wherein the single piece of paperboard further has a third lip, a fourth lip, a second flap extending from the third lip, and a third flap extending from the fourth lip, and wherein the second flap and the third flap are bent and affixed to the underside.

21. A packaging comprising:

a body formed from a single piece of paperboard having a first lip, a second lip opposite the first lip, a third lip, a fourth lip opposite the third lip, a first flap extending from the first lip, an underside extending from the second lip, a second flap extending from the third lip, and a third flap extending from the fourth lip, wherein the first lip, the second lip, the third lip, and the fourth lip form a topside defining a cutout, and wherein at least two of the first flap, the second flap, and the third flap are bent and affixed to the underside; and a polymer sheet affixed to the first lip, the second lip, the third lip, and the fourth lip to cover the cutout, the polymer sheet being configured to stretch over one or more items of different sizes upon insertion of the one or more items into the packaging to restrain the one or more items against the underside during transport.

22. The packaging of claim 21, wherein the body is padding-free.

* * * * *